US008536801B1

(12) United States Patent
Dernovsek

(10) Patent No.: US 8,536,801 B1
(45) Date of Patent: Sep. 17, 2013

(54) SYSTEM AND METHOD FOR INDIVIDUALLY MODULATING AN ARRAY OF LIGHT EMITTING DEVICES

(75) Inventor: John Jay Dernovsek, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 375 days.

(21) Appl. No.: 12/942,155

(22) Filed: Nov. 9, 2010

Related U.S. Application Data

(60) Provisional application No. 61/260,130, filed on Nov. 11, 2009.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| *H05B 39/02* | (2006.01) |
| *H05B 37/00* | (2006.01) |
| *H05B 39/00* | (2006.01) |
| *H05B 41/00* | (2006.01) |

(52) U.S. Cl.
USPC ..... 315/297; 315/209 R; 315/312

(58) Field of Classification Search
None
See application file for complete search history.

(56) References Cited

U.S. PATENT DOCUMENTS

| | | | | |
|---|---|---|---|---|
| 4,659,967 | A | 4/1987 | Dahl | |
| 5,274,747 | A | 12/1993 | Furuta et al. | |
| 5,995,546 | A * | 11/1999 | Richardson | 375/237 |
| 6,016,038 | A | 1/2000 | Mueller et al. | |
| 7,113,541 | B1 | 9/2006 | Lys et al. | |
| 7,233,115 | B2 | 6/2007 | Lys | |
| 2005/0128743 | A1 | 6/2005 | Chuey et al. | |
| 2008/0054825 | A1 | 3/2008 | Gulsen et al. | |
| 2008/0111503 | A1 * | 5/2008 | Ess et al. | 315/297 |
| 2011/0204797 | A1 * | 8/2011 | Lin et al. | 315/161 |

* cited by examiner

*Primary Examiner* — Douglas W Owens
*Assistant Examiner* — Dedei K Hammond
(74) *Attorney, Agent, or Firm* — Waddey & Patterson, P.C.; Mark J. Patterson; Gary L. Montle

(57) ABSTRACT

A system and method are provided for powering a lighting device having one or more arrays of LEDs. Three current sourcing circuits each include a switching element having a source coupled to an input power source. A microcontroller includes a processor, a communications module, an internal clock oscillator, a counter, and program instructions executable to cause the processor to carry out the control functions. Desired light intensity levels are stored as individual output level data, and pulse density modulated output values are generated for each of the stored output level data using carry overflow logic. The generated output values are converted to output signals and provided to the respective current sourcing circuits, wherein current is sourced through the switching elements to respective LEDs of a given color based on a pulse density modulated signal applied to the gates of the respective switching elements.

14 Claims, 6 Drawing Sheets

| cblock RAMSTART | |
|---|---|
| temp | temporary storage |
| r_bright<br>r_error | red bright level<br>red error accumulator |
| g_bright<br>g_error | green bright level<br>green error accumulator |
| b_bright<br>b_error | blue bright level<br>blue error accumulator |
| endc | |

*FIG. 5*

| | | |
|---|---|---|
| main_loop | | main program loop, 64uS |
| btfss<br>gotp | TMR0, 6<br>main_loop | wait for timer0 >= 64 |
| movlw<br>andwf | b'00111111'<br>TMR0, f | clear timer0 bits 7 and 6 |
| clrwdt | | clear watchdog timer |
| | | 0-255 pulse density modulation: |
| movf<br>addwf<br>rlf | b_bright, W<br>b_error, f<br>temp, f | blue, GP2<br>bright level (PDM numerator) --> W<br>numerator + error --> new error<br>carry bit --> temp (lsb) |
| movf<br>addwf<br>rlf | g_bright, W<br>g_error, f<br>temp, f | green, GP1<br>bright level (PDM numerator) --> W<br>numerator + error --> new error<br>carry bit --> temp (lsb) |
| movf<br>addwf<br>rlf | r_bright, W<br>r_error, f<br>temp, f | red, GP0<br>bright level (PDM numerator) --> W<br>numerator + error --> new error<br>carry bit --> temp (lsb) |
| movf<br>movwf | temp, W<br>GPIO | update PDM outputs<br>temp --> W<br>W --> GPIO |
| | | *** execute control code here *** |
| goto | main_loop | |

*FIG. 6*

SYSTEM AND METHOD FOR INDIVIDUALLY MODULATING AN ARRAY OF LIGHT EMITTING DEVICES

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: Provisional Patent Application No. 61/260,130, dated Nov. 11, 2009.

BACKGROUND OF THE INVENTION

The present invention relates generally to a system and method for operating and dimming lighting devices. More particularly, the present invention relates to a microcontroller and associated circuitry for individually controlling the lighting intensity of different color LEDs in a lighting device.

Pulse width modulated (PWM) output signals are commonly used to control the intensity of light-emitting elements in lighting devices. Separate PWM output signals may be provided to individual elements, or to a number of such elements in an array. Typically, timer peripherals contained within a microcontroller or an equivalent are configured to generate such signals with the quality and quantity of available outputs being determined by the design of the timer hardware. Hardware timers allow signals to be generated with little intervention from a central processor, but they also add complexity and cost to the microcontroller.

Timers having multiple output PWM output capability are further generally unavailable in the lowest cost microcontrollers. For example, conventional microcontrollers (such as for example a microcontroller 112 as shown in FIG. 7) which might be used for such a system generally include either three pulse-width modulation (PWM) timers or a single timer with three PWM channels (R, G, B). This can be particularly disadvantageous for the example of an RGB (Red, Green, Blue) LED (Light-Emitting Diode) array, where multiple PWM outputs would be desirable to individually modulate the relative light intensities associated with the various LED colors.

BRIEF SUMMARY OF THE INVENTION

Various embodiments of a system and method for independently powering and precisely controlling the lighting intensity of a plurality of lighting elements in a lighting device are provided herein in accordance with the present invention.

In an example, the lighting device may include one or more RGB LED arrays. The overall color of a lighting device including one or more such arrays is determined by independently modulating the brightness of each color. Each color may, for example, be set to one of 256 levels having a maximum level (i.e., 255) indicating full brightness and a minimum level (i.e., 0) indicating the light is completely off.

In an embodiment of an apparatus for powering a lighting device in accordance with the present invention, a controller includes a processor, a communications module, an internal clock oscillator, a counter, and one or more machine-readable memory media having program instructions residing thereon. The instructions are executable to cause the processor to receive a plurality of external control signals at the communications module associated with a desired light intensity level for respective individual lighting elements in the lighting device. The desired light intensity levels are stored as desired output level data in the memory media. Pulse density modulated output values are generated for each of the received external control signals using a carry overflow program method, and the generated output values are written to output terminals in the communications module associated with the respective lighting elements in the lighting device.

In another embodiment within the scope of the present invention, a system is provided for powering a lighting device having a plurality of lighting elements. A like plurality of current sourcing circuits each include a switching element having a source coupled to an input power source, and a drain coupled to the lighting device. A controller includes a processor, a communications module, an internal clock oscillator, a counter, and one or more machine-readable memory media having program instructions residing thereon. The instructions are executable to cause the processor to store desired light intensity levels as desired output level data in the memory media, and generate pulse density modulated output values for each of the stored output level data using a carry overflow program method. The generated pulse density modulated output values are then written to output terminals in the communications module, and a plurality of pulse density modulated output signals are provided to the respective current sourcing circuits based on the output values. Current is sourced through the switching elements to respective lighting elements based on a pulse density modulated signal applied to the gates of the respective switching elements.

In another embodiment of the present invention, a method is provided for powering a lighting device having for example one or more arrays of LEDs. A plurality of current sourcing circuits are provided, each including a switching element having a source coupled to an input power source. Desired light intensity levels are stored as desired output level data in one or more memory media residing in a microcontroller. The method further includes generating internally to the microcontroller pulse density modulated output values for each of the stored output level data using a carry overflow program method, and providing from the microcontroller a plurality of pulse density modulated output signals to respective current sourcing circuits based on the output values. Current is sourced through the switching elements to respective lighting elements based on a pulse density modulated signal applied to the gates of the respective switching elements.

BRIEF DESCRIPTION OF THE SEVERAL VIEWS OF THE DRAWINGS

FIG. 5 is an instruction list representing an example of memory media storage allocation in accordance with an embodiment of the present invention.

FIG. 6 is an instruction list representing an example of a pulse density modulation generator program in accordance with an embodiment of the present invention.

DETAILED DESCRIPTION OF THE INVENTION

Figure 1:
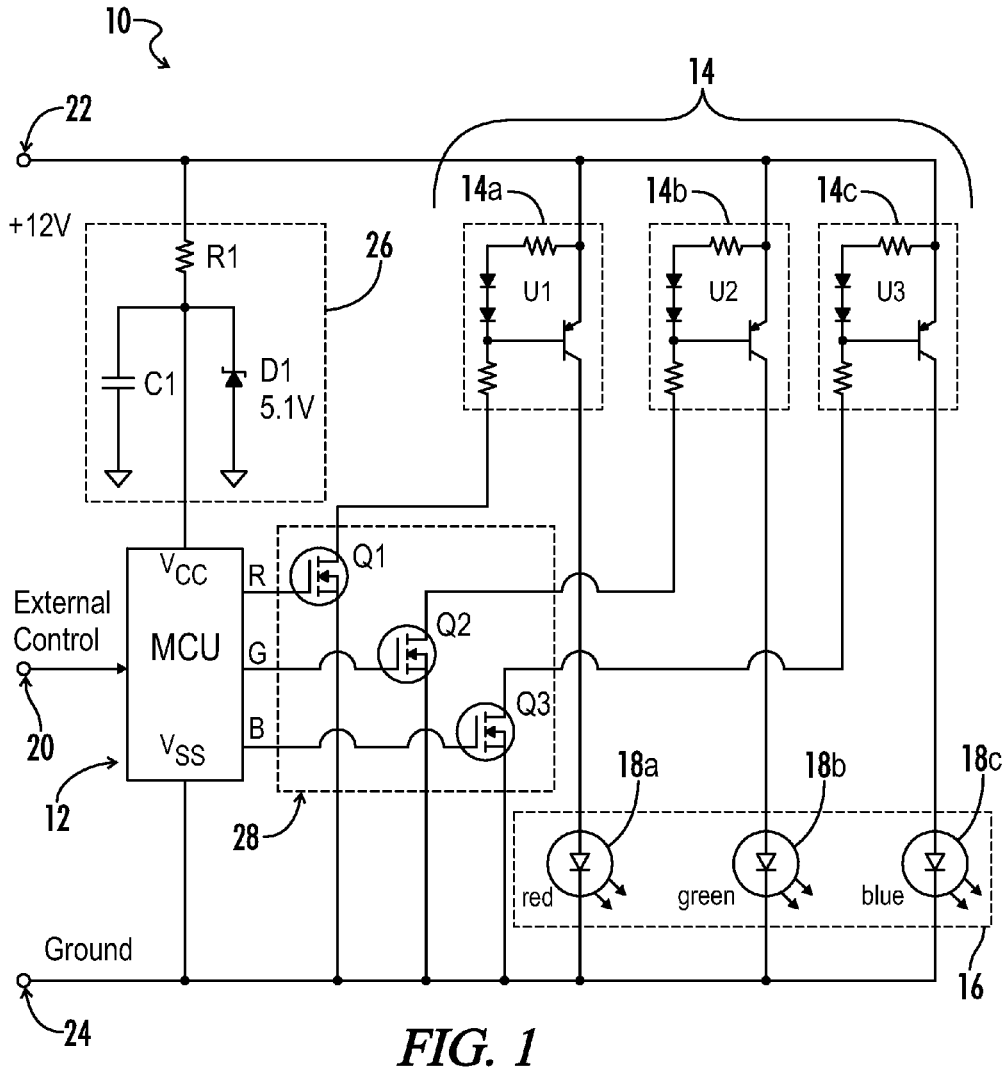
FIG. 1 is a circuit diagram representing an embodiment of a system for powering a lighting device in accordance with the present invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function.

The term "signal" means at least one current, voltage, charge, temperature, data or other signal.

The terms "switching element" and "switch" may be used interchangeably and may refer herein to at least: a variety of transistors as known in the art (including but not limited to FET, BJT, IGBT, JFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

Terms such as "providing," "processing," "supplying," "determining," "calculating" or the like may refer at least to an action of a controller, computer system, computer program, signal processor, logic or alternative analog or digital electronic device that may be transformative of signals represented as physical quantities, whether automatically or manually initiated.

Referring generally to FIGS. 1-6, various embodiments of a system and method for independently powering and precisely controlling the lighting intensity of a plurality of lighting elements in a lighting device are provided herein in accordance with the present invention. Where the various figures may describe embodiments sharing various common elements and features with other embodiments, similar elements and features are given the same reference numerals and redundant description thereof may be omitted below.

Referring first to FIG. 1, an embodiment of a system 10 may be described for independently modulating one or more lighting elements 18 in a lighting device 16. One or more current sourcing circuits 14 are arranged to receive pulse density modulated (PDM) output signals from a controller 12 and to independently source current to respective lighting elements 18 based on the received PDM signals. In various embodiments, a buffering circuit 28 may be provided between output terminals of the controller 12 and the current sourcing circuits 14, and a voltage regulator 26 may further be provided between the controller 12 and the positive rail 22 of the system 10.

The lighting elements may be red, green and blue light-emitting diodes (LEDs) arranged in one or more RGB LED arrays which may be available as a single device as is well known in the art. The overall color of a lighting device including one or more such arrays is determined by independently modulating the brightness of each color. The lighting device 16 may be expanded (or reduced) to include an array of any size within the limitations of the supply voltage, supply current, driver capacity and a number of available modulation signals. Each color may, for example, be set to one of 256 levels having a maximum level (i.e., 255) indicating full brightness and a minimum level (i.e., 0) indicating the light is completely off. Those persons having skill in the art will further recognize that the controller may easily be scaled to various alternative sizes and resolutions within the scope of the present invention.

Each lighting element 18*a*, 18*b*, 18*c* in a lighting device 16 as shown in FIG. 1 is independently driven by signals from a respective current sourcing circuit 14*a*, 14*b*, and 14*c*. The current sourcing circuits in various embodiments may be LED drivers U1, U2, U3 each of which provide a current source and act as a high side switch for a single respective color. The buffering circuit 28 includes switching elements Q1, Q2, Q3 or various equivalent structures which may provide buffering and voltage level shifting for the PDM output signals generated by the controller 12. The voltage regulator 26 includes a diode D1, a capacitor C1 and a resistor R1 as shown in FIG. 1, but various alternative configurations are well known in the art and may be anticipated within the scope of the present disclosure.

Figure 2:
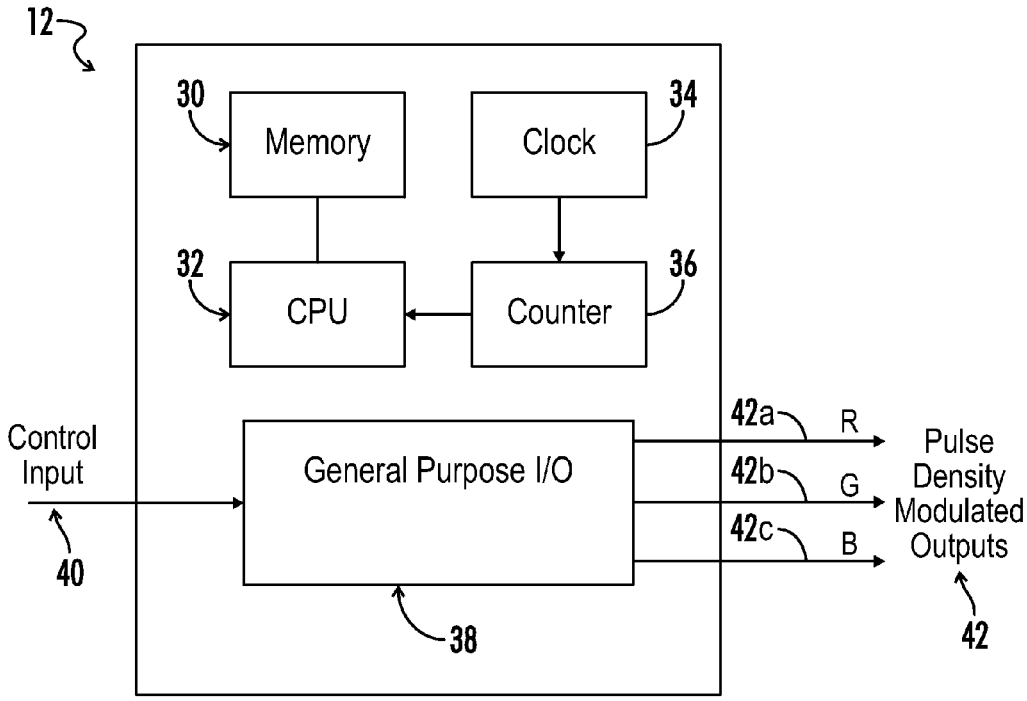
FIG. 2 is a block diagram representing an embodiment of a controller in accordance with the present invention.
Figure 3:
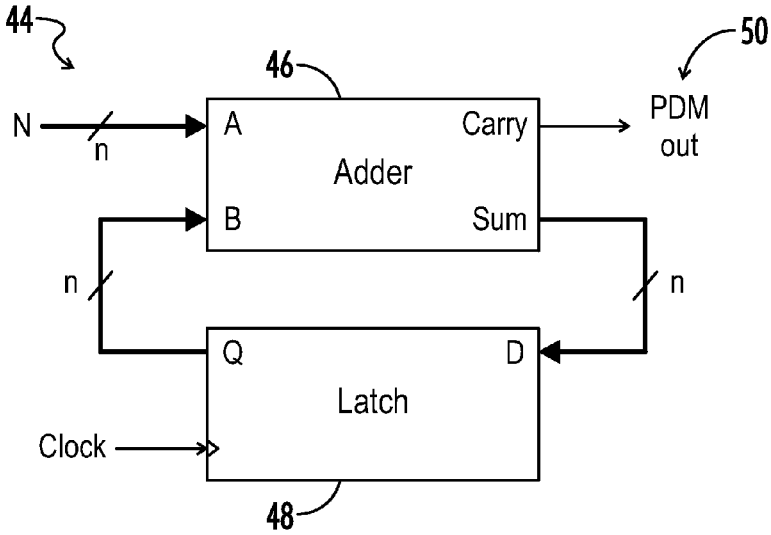
FIG. 3 is a block diagram representing an embodiment of a carry overflow pulse density modulation generator in accordance with the present invention.

The controller 12 in various embodiments of the present invention such as, for example, shown in FIG. 2 includes a processor 32, a communications module 38, an internal clock oscillator 34, a counter 36, and one or more machine-readable memory media 30.

The term "controller" as used herein may refer to at least a general microprocessor, an application specific integrated circuit (ASIC), a digital signal processor (DSP), a microcontroller, a field programmable gate array, or various alternative blocks of discrete circuitry as known in the art, designed to perform functions as further defined herein.

The term "machine-readable memory medium" as used herein may refer to any medium alone or as one of a plurality of memory media having processor-executable software, instructions or program modules which upon execution may provide data or otherwise cause a controller or computer system to implement subject matter or otherwise operate in a specific manner as further defined herein. It may further be understood that more than one type of memory media may be used in combination to conduct machine-executable software, instructions or program modules from a first memory medium upon which the software, instructions or program modules initially reside to a processor for execution.

"Memory media" may further include, without limitation, transmission media and/or storage media. "Storage media" may refer in an equivalent manner to volatile and non-volatile, removable and non-removable media, including at least dynamic memory, application specific integrated circuits (ASIC), chip memory devices, optical or magnetic disk memory devices, flash memory devices, or any other medium which may be used to stored data in a machine- or processor-accessible manner, and may unless otherwise stated either reside on a single computing platform or be distributed across a plurality of such platforms. "Transmission media" may include any tangible media effective to permit processor-executable software, instructions or program modules residing on the media to be read and executed by a processor, including without limitation wire, cable, fiber-optic and wireless media such as is known in the art.

The term "processor" as used herein may refer to at least general-purpose or specific-purpose processing devices and/or logic as may be understood by one of skill in the art, including but not limited to central processors, parent processors, graphical processors, media processors, and the like.

In an embodiment of the present invention, a controller 12 having functionality as described in greater detail below may be a self-contained computing unit having the necessary resources to generate one or more independent modulation signals (i.e., 42*a*, 42*b*, 42*c* as shown), one for each respective current source circuit or LED driver (i.e., 14*a*, 14*b*, 14*c*). The controller 12 may receive an external control signal from an external control source 40 for determining light intensity, and in fact a time period may be allotted by an embodiment of an operating method for the controller to receive and process such a signal, but other equivalent methods for receiving, generating or otherwise obtaining a desired light intensity value are within the scope of the present invention. Detail of such external control is more particularly outside of the scope of the present invention and may therefore be omitted herein.

The controller 12 in a particular embodiment may be a PIC10F200 microcontroller, upon which much of the following description will be based, although such description is not intended as limiting and alternative controllers 12 are of course within the scope of the present invention. The PIC10F200 is a six-pin device containing a 4 MHz internal clock oscillator, an 8-bit processor, 256 word program memory, 16 byte Random Access Memory (RAM), and an 8-but timer/counter. Three of four pins in the communication module (i.e., I/O ports) are configured as output terminals for modulating the respective LED colors in the lighting device, and the remaining I/O port may be used as an optional control input terminal.

The oscillator in the controller 12 as described above may be divided by a factor of four so as to yield a 1 MHz instruction cycle clock. One instruction is thereby executed every microsecond. In various embodiments the 8-bit timer/counter 36 is configured to be clocked by the instruction cycle clock. The timer/counter 36 is incremented once per microsecond, and serves as the time reference for a main program loop (see for example FIG. 6). For this example, the timer/counter 36 is polled in the main program loop and waits for a count of 64 microseconds to occur before executing the remainder of the loop. Longer periods, up to 256 microseconds, may be realized without adding additional instructions.

The pulse density modulated output signals are in various embodiments generated by one or more carry overflow logic circuits (pulse density modulation generators) including an adder 42 and a latch 40 (see FIG. 3) using a carry overflow program. For an 8-bit system (n=8), the overflow integrator is self-correcting when the resolution equals 256 levels (for example, where 0 defines a minimum and 255 defines a maximum light intensity). This resolution is well beyond the perception of the human eye while requiring a minimal amount of program code. Other resolutions are within the scope of the present invention, however, additional instructions and/or memory may be needed for such cases.

Figure 4:
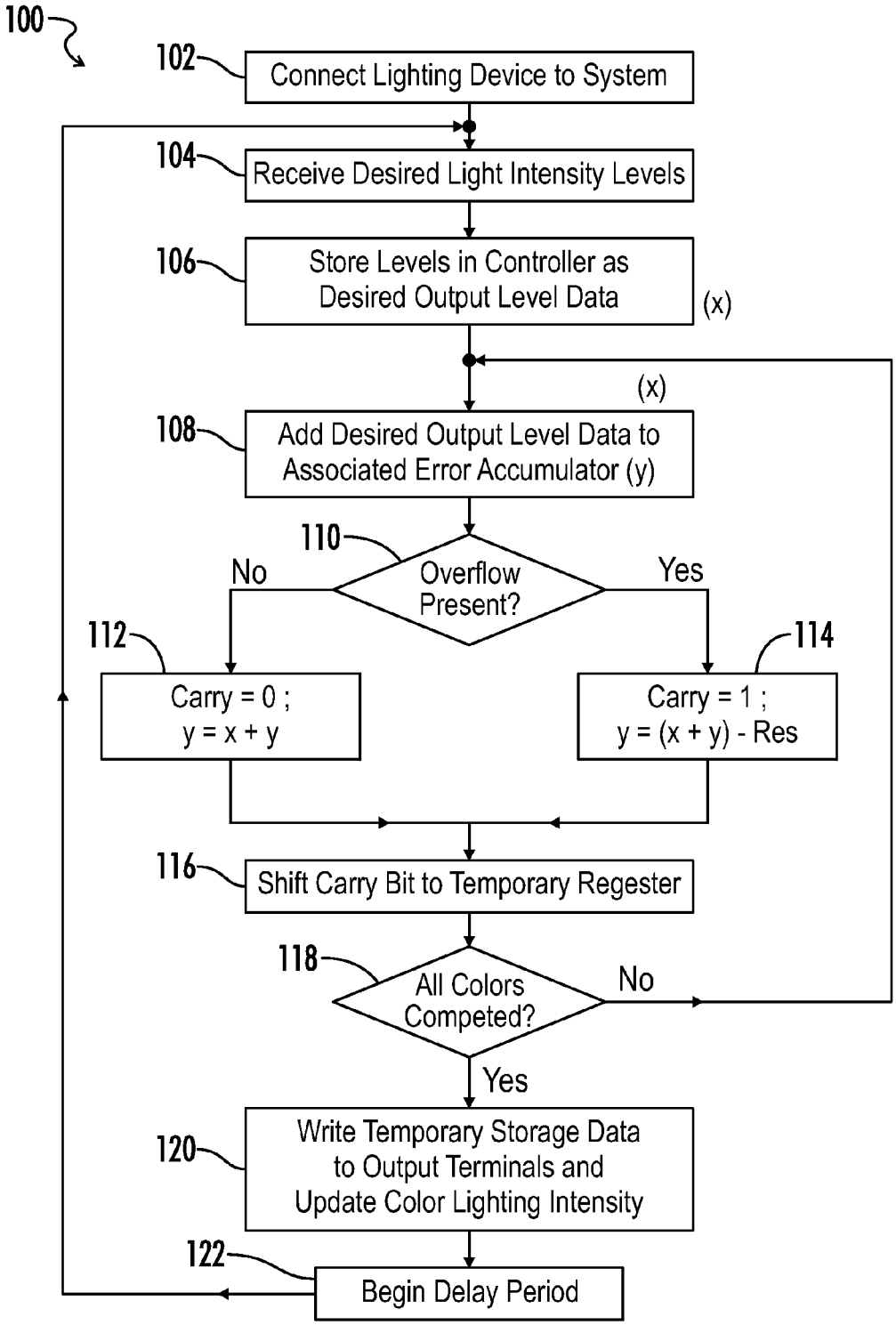
FIG. 4 is a flowchart representing an embodiment of a method for powering a lighting device in accordance with the present invention.
Figure 7:
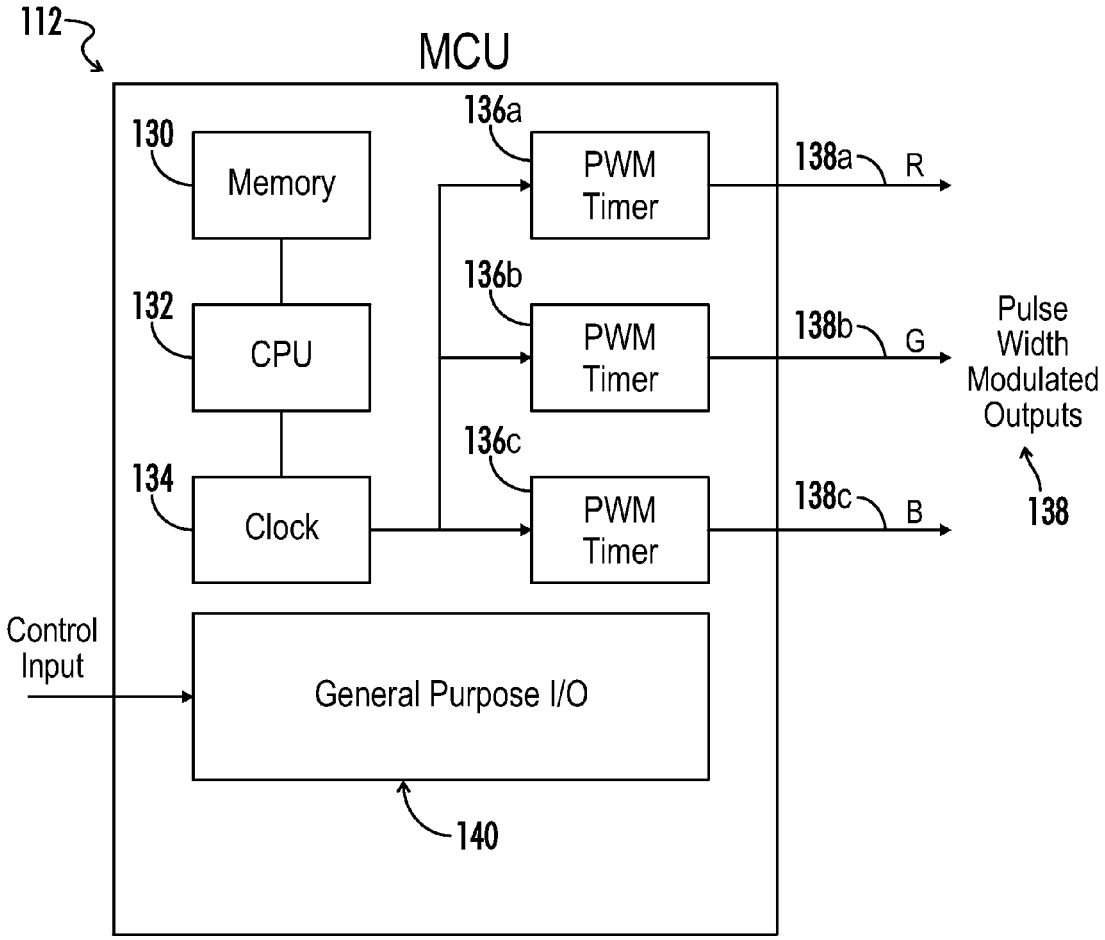
FIG. 7 (PRIOR ART)
FIG. 7 is a block diagram representing an embodiment of a controller as conventionally known in the art.

Referring now to FIG. 4, a method of operation 100 may be described in accordance with various embodiments of a system 10 and controller 12 of the present invention.

When a lighting device 16 has been coupled to the system 10 (step 102), the controller 12 receives, generates or otherwise obtains desired intensity levels associated with one or more respective lighting elements in the lighting device (step 104).

The RGB pulse density generator program uses 7 bytes of RAM (see for example the allocation list 52 as represented in FIG. 5). Each color uses one byte to store the desired light intensity levels as desired output level data X (step 106), and one byte as an error accumulator Y. An additional byte of RAM may be used for temporary storage.

The output level data is added to the error accumulator (X+Y) upon every iteration of the method (step 108). It then may be determined by the controller if an overflow has occurred (step 110). If the sum is less than a number RES (in this example 256) associated with the resolution (i.e., "no" in response to the query in step 110), no overflow occurred and the carry bit is cleared (carry=0). The error accumulator simply retains the current sum (Y=X+Y) (step 112).

If the sum is 256 or greater (i.e., "yes" in response to the query in step 110) in this example, the error accumulator has overflowed and the carry bit is set (carry=1). The value left in the error accumulator equals the sum minus 256 (Y=(X+Y)−256) by nature of the overflow (step 114). For resolutions other than 256, an additional subtraction would need to be performed to realign the error accumulator.

The resultant carry equals the generator output and is shifted into a temporary register (step 116). In various embodiments the output bits may be configured to equal the three least significant bits of the I/O port, and no further alignment of the accumulated carry bits are required. The controller then determines if each color has been completed (step 118). If not (i.e., "no" in response to the query in step 118), the method returns to step 108 and proceeds with the next color. If all three channels have been computed, however (i.e., "yes" in response to the query in step 118), the temporary storage is written to the output terminals, simultaneously updating all three colors (step 120).

In various embodiments the method 100 may at this point initiate a delay period (step 122) between the completion of a previous program loop and the beginning of a new program loop (i.e., returning of the method to step 104). In a particular example, as represented in the program example 54 of FIG. 6, three channels of PDM generation use 11 instructions. Three additional instructions are used to condition the timer/counter and clear the controller watchdog timer, yielding a total of 14 instructions. There are no branches in this particular routine, and therefore the execution time is consistent. Polling of the counter/timer uses two more instructions. Program jumps use two clock cycles, and therefore 45 microseconds remain out of the 64 microsecond poll for executing another one or more routines such as for example an external control receiver routine.

The previous detailed description has been provided for the purposes of illustration and description. Thus, although there have been described particular embodiments of the present invention of a new and useful "System and Method for Individually Modulating an Array of Light Emitting Devices," it is not intended that such references be construed as limitations upon the scope of this invention except as set forth in the following claims.

What is claimed is:

1. An apparatus for powering a lighting device, the apparatus comprising:

a controller including a processor, a communications module, an internal clock oscillator, a counter, and one or more non-transient machine-readable memory media having program instructions residing thereon, the instructions executable to cause the processor to receive external control signals associated with individual desired light intensity levels for a blue color LED, a red color LED and a green color LED associated with each of one or more arrays of light-emitting diodes in the lighting device;

store the desired light intensity levels as desired output level data in the memory media;

generate pulse density modulated output values for each of the received external control signals using a carry overflow logic circuit; and write the generated output values to output terminals in the communications module associated with the respective lighting elements in the lighting device, the one or more memory media further comprising random-access memory media having a plurality of bytes allocated for each color LED, one of the bytes allocated for the desired output level data and one of the bytes allocated for an error accumulator.

2. The apparatus of claim 1, the instructions further executable to cause the processor to add the desired output level data stored in the random-access memory media to the associated error accumulator;

determine the presence of an overflow in each error accumulator;

set or clear a carry bit associated with each error accumulator depending on the overflow determination; and shift the carry bits further defining the generated output values to a temporary register, wherein the pulse density modulated output values are generated for each of the received external control signals.

3. The apparatus of claim 2, the instructions further executable to cause the processor to increment the counter as a reference for each step in the program;

delay the beginning of a new carry overflow program loop from the end of a previous carry overflow program loop until the end of a predetermined time frame including the previous loop; and executing a control signal receiving program during the delay between the carry overflow program loops, wherein desired light intensity levels are obtained from an external source.

4. A system for powering a lighting device having a plurality of light-emitting diodes, the system comprising:

an input power source;

a plurality of current sourcing circuits each comprising a switching element having a source coupled to the input power source;

a plurality of switching elements defining a buffering circuit coupled between the output terminals and the respective current sourcing circuits; and a controller including output terminals, a processor, a communications module, an internal clock oscillator, a counter, and one or more non-transient machine-readable memory media having program instructions residing thereon, the instructions executable to cause the processor to store desired light intensity levels as desired output level data in the memory media, the desired light intensity levels associated with individual desired light intensity levels for a blue color LED, a red color LED and a green color LED associated with each of one or more arrays of light-emitting diodes;

generate pulse density modulated output values for each of the stored output level data using a carry overflow logic circuit;

write the generated pulse density modulated output values to the output terminals; and provide a plurality of pulse density modulated output signals to the respective current sourcing circuits based on the output values, wherein current is sourced through the switching elements to respective lighting elements based on a pulse density modulated signal applied to the gates of the respective switching elements.

5. The system of claim 4, further comprising an input terminal of the communications module effective to receive a plurality of external control signals associated with the desired light intensity level for respective color LEDs in the lighting device.

6. The apparatus, system of claim 4, the one or more memory media further comprising random-access memory media having a plurality of bytes allocated for each color LED, one of the bytes allocated for the desired output level data and one of the bytes allocated for an error accumulator.

7. The system of claim 6, the instructions executable to cause the processor to add the desired output level data stored in the random-access memory media to the associated error accumulator;

determine the presence of an overflow in each error accumulator;

set or clear a carry bit associated with each error accumulator depending on the overflow determination; and shift the carry bits further defining the generated output values to a temporary register, wherein the pulse density modulated output values are generated for each of the received external control signals.

8. The system of claim 7, the instructions further executable to cause the processor to increment the counter as a reference for each step in the program;

delay the beginning of a new carry overflow program loop from the end of a previous carry overflow program loop until the end of a predetermined time frame including the previous loop; and executing a control signal receiving program during the delay between the carry overflow program loops.

9. A method of powering a lighting device having a plurality of lighting elements, the method comprising:

providing a plurality of current sourcing circuits each comprising a switching element having a source coupled to an input power source; and receiving a plurality of external control signals associated with individual desired light intensity levels to be provided for a blue color LED, a red color LED and a green color LED associated with each of one or more arrays of light-emitting diodes and storing the desired light intensity levels as desired output level data in one or more memory media residing in a microcontroller;

adding the desired output level data stored in the memory media to an associated error accumulator;

determining the presence of an overflow in each error accumulator;

setting or clearing a carry bit associated with each error accumulator depending on the overflow determination;

shifting the carry bits further defining pulse density modulated output values to a temporary register; and providing from the microcontroller a plurality of pulse density modulated output signals to respective current sourcing circuits based on the output values, wherein current is sourced through the switching elements to respective lighting elements based on a pulse density modulated signal applied to the gates of the respective switching elements.

10. The method of claim 9, the step of generating internally to the microcontroller the pulse density modulated output values for each of the received external control signals further comprising the steps of incrementing a counter as a reference for each step in the program;

delaying the beginning of a new carry overflow program loop from the end of a previous carry overflow program loop until the end of a predetermined time frame including the previous loop.

11. The method of claim 10, further comprising the step of executing a control signal receiving program during the delay between the carry overflow program loops.

12. A system for powering a lighting device having a plurality of light-emitting diodes, the system comprising:

an input power source;

a plurality of current sourcing circuits each comprising a switching element having a source coupled to the input power source; and a controller including output terminals, a processor, a communications module, an internal clock oscillator, a counter, and one or more non-transient machine-readable memory media having program instructions residing thereon, the instructions executable to cause the processor to store desired light intensity levels as desired output level data in the memory media, the desired light intensity levels associated with individual desired light intensity levels for a blue color LED, a red color LED and a green color LED associated with each of one or more arrays of light-emitting diodes;

generate pulse density modulated output values for each of the stored output level data using a carry overflow logic circuit;

write the generated pulse density modulated output values to the output terminals; and provide a plurality of pulse density modulated output signals to the respective current sourcing circuits based on the output values, wherein current is sourced through the switching elements to respective lighting elements based on a pulse density modulated signal applied to the gates of the respective switching elements, the one or more memory media further comprising random-access memory media having a plurality of bytes allocated for each color LED, one of the bytes allocated for the desired output level data and one of the bytes allocated for an error accumulator.

13. The system of claim 12, the instructions executable to cause the processor to add the desired output level data stored in the random-access memory media to the associated error accumulator;

determine the presence of an overflow in each error accumulator;

set or clear a carry bit associated with each error accumulator depending on the overflow determination; and shift the carry bits further defining the generated output values to a temporary register, wherein the pulse density modulated output values are generated for each of the received external control signals.

14. The system of claim 13, the instructions further executable to cause the processor to increment the counter as a reference for each step in the program;

delay the beginning of a new carry overflow program loop from the end of a previous carry overflow program loop until the end of a predetermined time frame including the previous loop; and executing a control signal receiving program during the delay between the carry overflow program loops.

* * * * *